US008373604B2

(12) United States Patent
Wong et al.

(10) Patent No.: US 8,373,604 B2
(45) Date of Patent: Feb. 12, 2013

(54) MULTIBAND MOBILE COMMUNICATION DEVICE AND ANTENNA THEREOF

(75) Inventors: Kin-Lu Wong, Tapei Hsien (TW); Wei-Yu Chen, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 390 days.

(21) Appl. No.: 12/648,341

(22) Filed: Dec. 29, 2009

(65) Prior Publication Data

US 2011/0095949 A1 Apr. 28, 2011

(30) Foreign Application Priority Data

Oct. 26, 2009 (TW) ..... 98136192 A

(51) Int. Cl.
*H01Q 1/24* (2006.01)

(52) U.S. Cl. ..... 343/702

(58) Field of Classification Search ..... 343/700 MS, 343/702, 846
See application file for complete search history.

(56) References Cited

U.S. PATENT DOCUMENTS

2008/0180333 A1* 7/2008 Martiskainen et al. ..... 343/722
2010/0328164 A1* 12/2010 Huynh ..... 343/702

* cited by examiner

*Primary Examiner* — Robert Karacsony
(74) *Attorney, Agent, or Firm* — Alan Kamrath; Kamrath IP Lawfirm, PA

(57) ABSTRACT

A multiband mobile communication device has a ground plane and an antenna. The antenna is disposed on a dielectric substrate. The antenna includes a monopole, a shorted radiating portion, a first radiating branch, and a second radiating branch. The monopole includes a feeding end, and the feeding end is the feeding point of the antenna. The shorted radiating portion has a shorting end electrically connected to the ground plane, and its other end is left open. The shorted radiating portion is extended along the monopole and has a coupling gap to the monopole. The first radiating branch has an end electrically connected to the shorted radiating portion, and its other end is left open. The first radiating branch is extended toward the shorting end of the shorted radiating portion and located on the opposite side of the monopole. The second radiating branch has an end electrically connected to the shorted radiating portion, and its other end is left open. The second radiating branch is extended along the first radiating branch, with the first radiating branch located between the second radiating branch and the shorted radiating portion.

9 Claims, 5 Drawing Sheets

MULTIBAND MOBILE COMMUNICATION DEVICE AND ANTENNA THEREOF

BACKGROUND OF THE INVENTION

1. Field of the Invention

The present invention relates to a mobile communication device and antenna thereof. More particularly, the present invention relates to a mobile communication device and antenna thereof capable of performing multiband operations.

2. Description of the Related Art

The development of mobile communication devices is getting faster. With the vigorous development of the wireless wide area network (WWAN) and long term evolution (LTE) techniques, people have higher and higher expectations of mobile communication devices. Because each country adopts different types of communication systems, there are numerous wireless network systems in the market, such as LTE700/2300/2500, GSM850/900/1800/1900 and UMTS. Therefore, a mobile communication device needs not only to be light, thin and compact, but also needs to cover multiband operations. In order to meet the requirement of multiband operations, a mobile communication device can be designed to utilize a coupling-feed technique so that its internal antenna achieves the characteristics of multiband operations.

However, with the progress of communication technology, more and more operating bands are applied in communications, such that the mobile communication device needs to cover a wider and wider operating bandwidth. As a result, even a communication device having a conventional coupled-fed antenna cannot cover all required operating bands. For example, Taiwan Patent No. I295517 (Internal multi-band antenna) discloses an internal coupled-fed mobile communication device antenna which is only capable of covering 4-band GSM900/1800/1900/UMTS operations.

Hence, the abovementioned conventional coupling-feed mechanism cannot provide a mobile communication device to completely cover 8-band LTE/GSM/UMTS operations, including 3-band LTE700/GSM850/900 (698~960 MHz) operations and 5-band GSM1800/1900/UMTS/LTE2300/2500 (1710~2690 MHz) operations, while still keeping the antenna with a small size.

Therefore, it is necessary to provide a multiband mobile communication device and antenna thereof to overcome the deficiency encountered by the prior art techniques.

SUMMARY OF THE INVENTION

It is an object of the present invention to provide a multiband mobile communication device which is capable of covering 8-band LTE/GSM/UMTS operations.

It is another object of the present invention to provide an antenna which is capable of covering 8-band LTE/GSM/UMTS operations.

To achieve the abovementioned objects, the multiband mobile communication device of the present invention has a ground plane and an antenna. The ground plane is a system ground plane of a mobile phone. The antenna comprises: a monopole, a shorted radiating portion, a first radiating branch, and a second radiating branch. The monopole includes a feeding end, which is a feeding point of the antenna. The monopole generates a first resonant mode of the antenna. The shorted radiating portion has one end as a shorting end electrically connected to the ground plane, while the other end is left open. The shorted radiating portion is extended along the monopole and has a coupling gap to the monopole. The shorted radiating portion generates a second resonant mode of the antenna by the coupling excitation of the monopole. The first radiating branch has one end electrically connected to the shorted radiating portion, while the other end is left open. The first radiating portion is extended toward the shorting end of the shorted radiating portion, and the first radiating branch is located on the opposite side of the monopole. The first radiating branch generates a third resonant mode. The third resonant mode and the first resonant mode form a first operating band of the antenna. The second radiating branch has one end electrically connected to the shorted radiating portion, while the other end is left open. The second radiating branch is extended along the first radiating branch, with the first radiating branch located between the second radiating branch and the shorted radiating portion. The second radiating branch generates a fourth resonant mode. The fourth resonant mode and the second resonant mode form a second operating band of the antenna.

To achieve the abovementioned objects, the antenna of the present invention comprises: a monopole, a shorted radiating portion, a first radiating branch, and a second radiating branch. The monopole includes a feeding end which is a feeding point of the antenna. The monopole generates a first resonant mode of the antenna. The shorted radiating portion has one end as a shorting end electrically connected to the ground plane, while the other end is left open. The shorted radiating portion is extended along the monopole and has a coupling gap to the monopole. The shorted radiating portion generates a second resonant mode of the antenna by the coupling excitation of the monopole. The first radiating branch has one end electrically connected to the shorted radiating portion, while the other end is left open. The first radiating portion is extended toward the shorting end of the shorted radiating portion, and the first radiating branch is located on the opposite side of the monopole. The first radiating branch generates a third resonant mode. The third resonant mode and the first resonant mode form a first operating band of the antenna. The second radiating branch has one end electrically connected to the shorted radiating portion, while the other end is left open. The second radiating branch is extended along the first radiating branch, with the first radiating branch located between the second radiating branch and the shorted radiating portion. The second radiating branch generates a fourth resonant mode. The fourth resonant mode and the second resonant mode form a second operating band of the antenna.

According to one preferred embodiment of the present invention, the coupling gap is less than 2 mm.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, similar reference numerals denote similar elements throughout the several views.

DETAILED DESCRIPTION OF THE PREFERRED EMBODIMENTS

Figure 1:
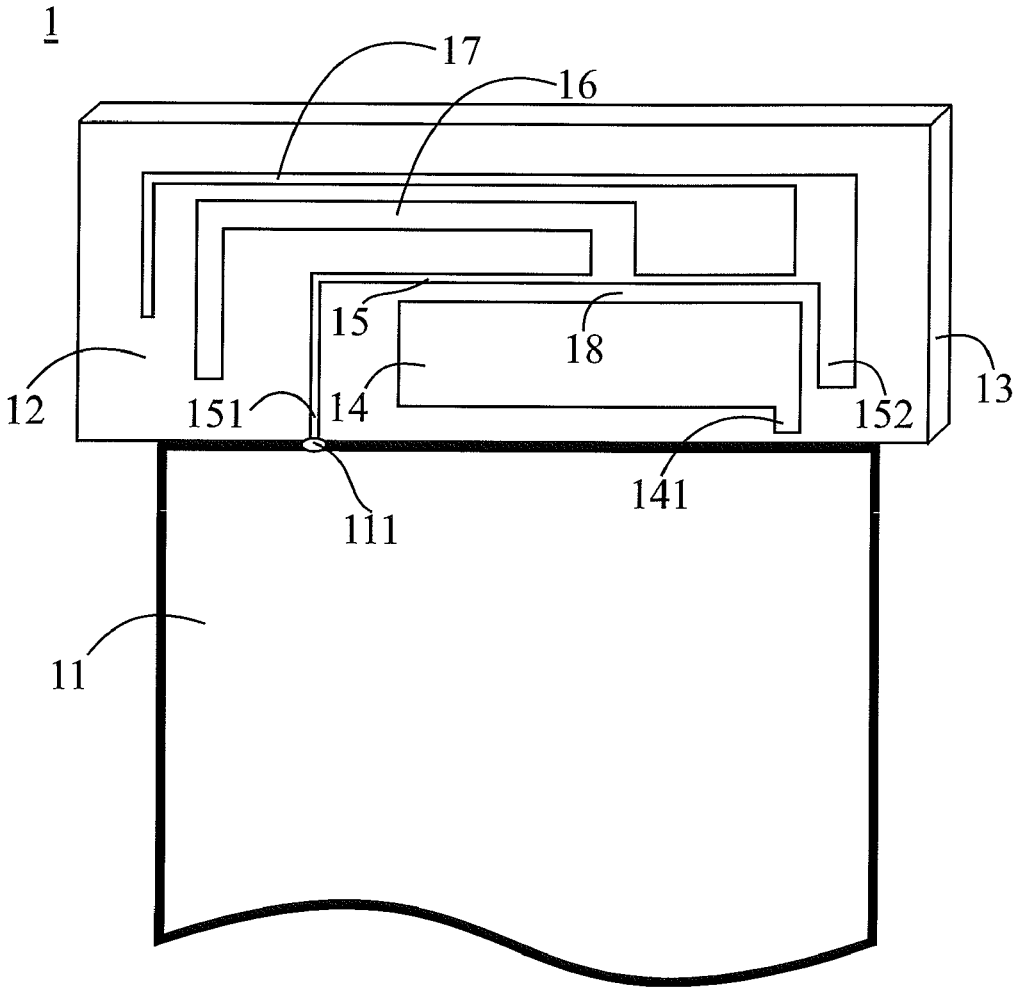
FIG. 1 illustrates a structural view of a multiband mobile communication device in a first embodiment of the present invention.
Figure 2:
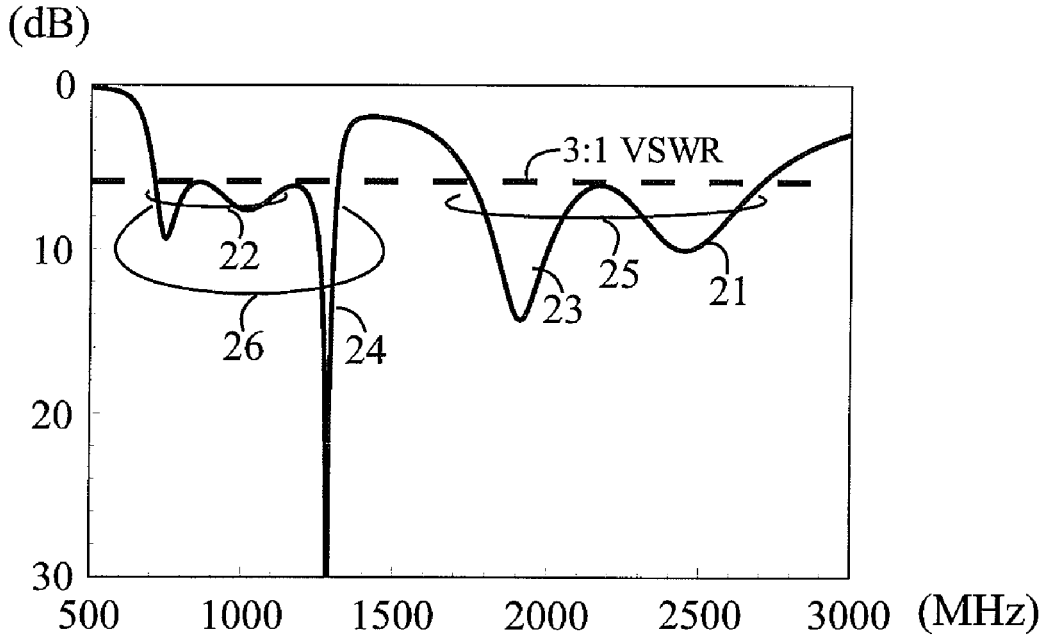
FIG. 2 illustrates a diagram of a simulated return loss of the mobile communication device in the first embodiment of the present invention.

Please refer to both FIG. 1 and FIG. 2. FIG. 1 illustrates a structural view of a multiband mobile communication device in a first embodiment of the present invention. FIG. 2 illustrates a diagram of a simulated return loss of the mobile communication device in the first embodiment of the present invention. The multiband mobile communication device 1 has a ground plane 11 and an antenna 12. The ground plane 11 is a system ground plane of a mobile communication device, or a system ground plane of a mobile phone. The antenna 12 can be formed on a dielectric substrate 13 by printing, etching or injection-molding. The antenna 12 comprises: a monopole 14, a shorted radiating portion 15, a first radiating branch 16, and a second radiating branch 17.

A feeding end 141 of the monopole 14 is a feeding point of the antenna 12. The monopole 14 generates a first (also the highest) resonant mode 21 (as shown in FIG. 2) of the antenna 12. In this embodiment, the monopole 14 is approximately an inverted-L shape.

One end of the shorted radiating portion 15 is a shorting end 151, which is electrically connected to a ground point 111 of the ground plane 11. The other end of the shorted radiating portion 15 is an open end 152. The shorted radiating portion 15 is extended along the monopole 14, and has a coupling gap 18 to the monopole 14. In this embodiment, the coupling gap 18 is less than 2 mm. The shorted radiating portion 15 generates a second (also the lowest) resonant mode 22 (as shown in FIG. 2) of the antenna 12 by the coupling excitation of the monopole 14.

The first radiating branch 16 has one end electrically connected to the shorted radiating portion 15, while the other end is left open. The first radiating branch 16 is extended toward the shorting end 151 of the shorted radiating portion 15, and the first radiating branch 16 is located on the opposite side of the monopole 14. The first radiating branch 16 generates a third resonant mode 23 (as shown in FIG. 2). The third resonant mode 23 and the first resonant mode 21 form a first (also the higher) operating band 25 (as shown in FIG. 2) of the antenna 12. The first operating band 25 can cover 1710~2690 MHz.

The second radiating branch 17 has one end electrically connected to the shorted radiating portion 15, while the other end is left open. The second radiating branch 17 is extended along the first radiating branch 16, with the first radiating branch 16 located between the second radiating branch 17 and the shorted radiating portion 15. The second radiating branch 17 generates a fourth resonant mode 24 (as shown in FIG. 2). The fourth resonant mode 24 and the second resonant mode 22 form a second (also the lower) operating band 26 (as shown in FIG. 2) of the antenna 12. The second operating band 26 can cover 698~960 MHz.

In FIG. 2, the horizontal axis represents the operating frequency, and the vertical axis represents the return loss. In the first embodiment, the simulation is performed according to the following design: the ground plane 11 is about 100 mm in length and 40 mm in width; the surface area of the antenna 12 is about 40×15 $mm^2$; the dielectric substrate 13 is a dielectric substrate of relative permittivity about 4.4 and with about 45 mm in length, 15 mm in width and 0.8 mm in thickness; the monopole 14 is a metal sheet with an inverted-L shape of about 24 mm in length and 6 mm in width; the shorted radiating portion 15 is about 39 mm in length and 0.5 mm in width; the first radiating branch 16 is about 38 mm in length and 1.5 mm in width; and the second radiating branch 17 is about 49 mm in length and 1 mm in width.

As shown in FIG. 2, the multiband mobile communication device 1 of the first embodiment can generate the first (highest) resonant mode 21, the second (lowest) resonant mode 22, the third resonant mode 23, and the fourth resonant mode 24 of the antenna. The first (highest) resonant mode 21 and the third resonant mode 23 form the first (higher) operating band 25 of the antenna. With the definition of 3:1 VSWR return loss (according to mobile communication device antenna design guidelines), the first (highest) operating band 25 can cover at least 1710~2690 MHz. The second (lowest) resonant mode 22 and the fourth resonant mode 24 form the second (lower) operating band 26, which can cover at least 680~960 MHz. Therefore, the first operating band 25 and the second operating band 26 are capable of covering 8-band LTE/GSM/UMTS operations.

Figure 3:
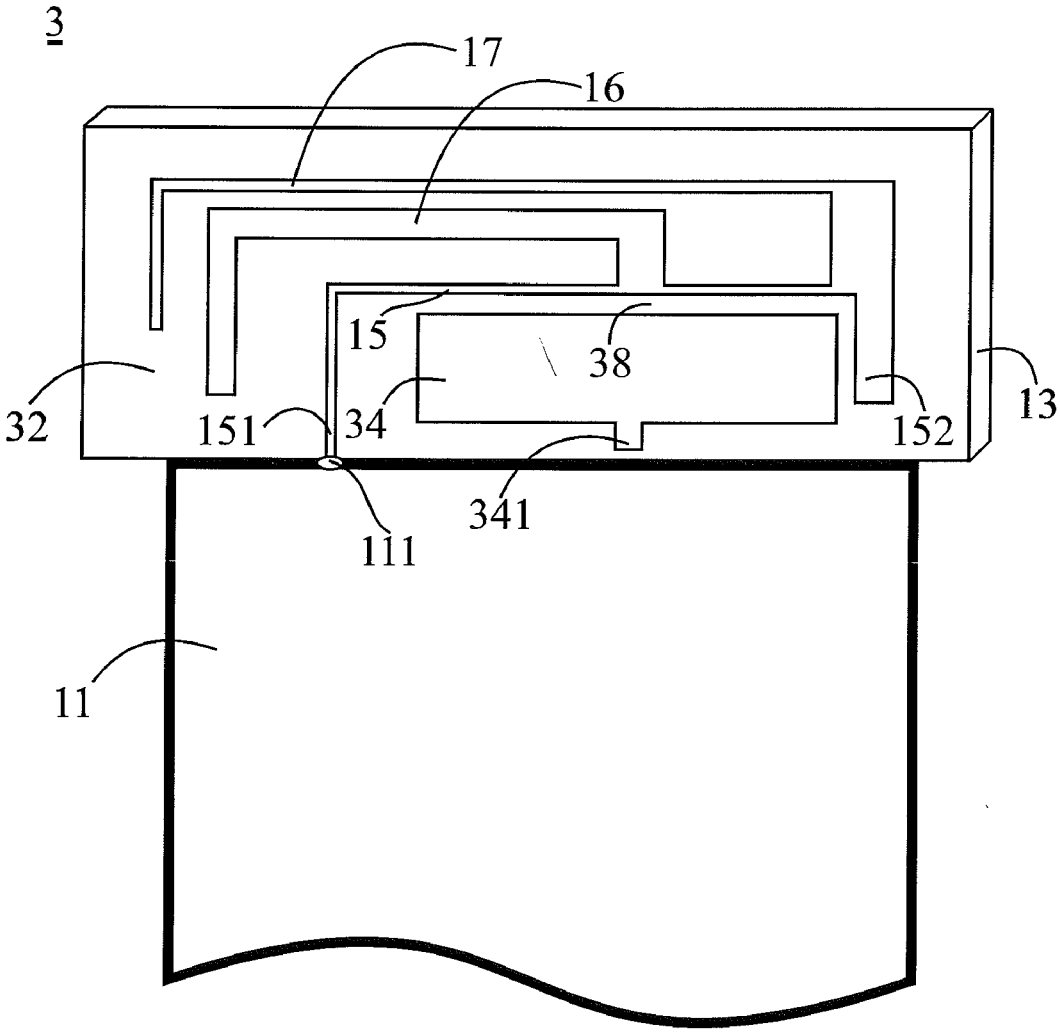
FIG. 3 illustrates a structural view of a multiband mobile communication device in a second embodiment of the present invention.

FIG. 3 illustrates a structural view of a multiband mobile communication device in a second embodiment of the present invention. The multiband mobile communication device 3 has a ground plane 11 and an antenna 32. The antenna 32 comprises: a monopole 34, a shorted radiating portion 15, a first radiating branch 16, and a second radiating branch 17. The overall structure of the second embodiment is similar to that of the first embodiment, except that the monopole 34 of the second embodiment is a metal sheet approximately of a T-shape. A feeding end 341 of the monopole 34 is a feeding point of the antenna 32. The shorted radiating portion 15 has a coupling gap 38 to the monopole 34.

Figure 4:
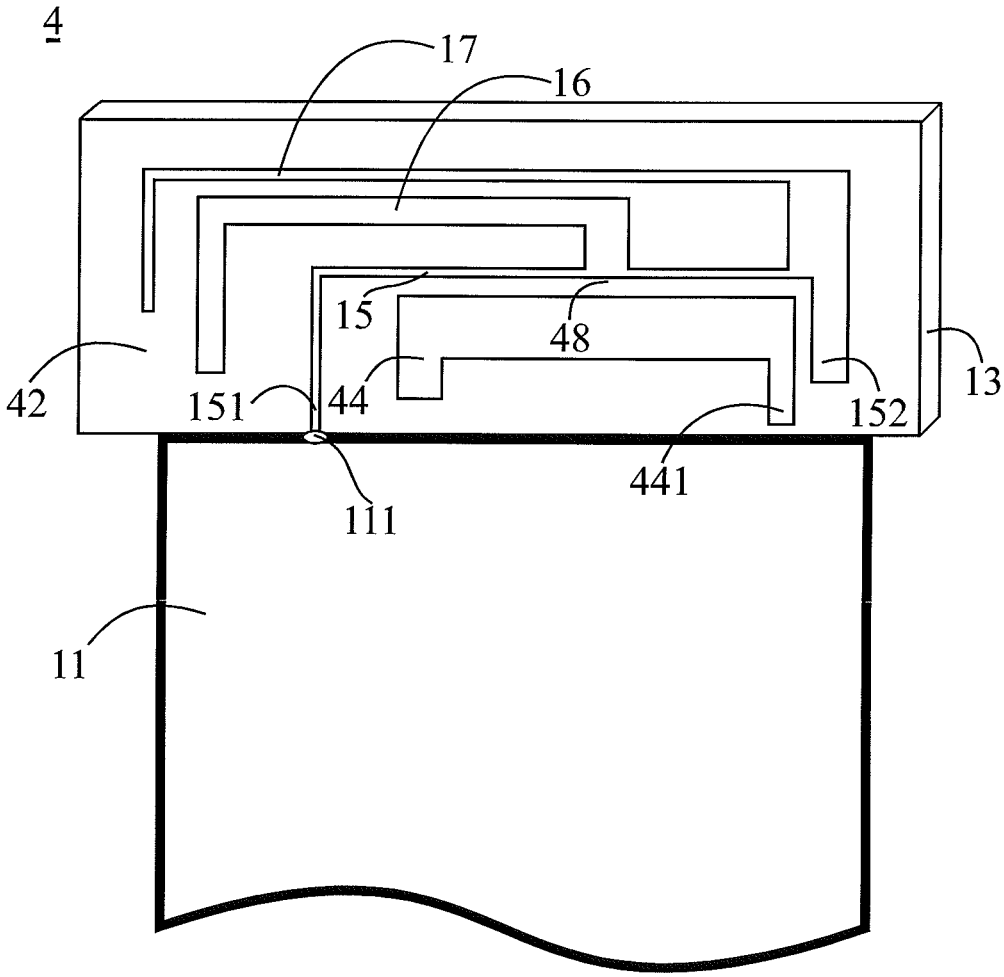
FIG. 4 illustrates a structural view of a multiband mobile communication device in a third embodiment of the present invention.

FIG. 4 illustrates a structural view of a multiband mobile communication device in a third embodiment of the present invention. The multiband mobile communication device 4 has a ground plane 11 and an antenna 42. The antenna 42 comprises: a monopole 44, a shorted radiating portion 15, a first radiating branch 16, and a second radiating branch 17. The overall structure of the third embodiment is similar to that of the first embodiment, except that the monopole 44 of the third embodiment is a metal sheet approximately of an inverted-U shape. A feeding end 441 of the monopole 44 is a feeding point of the antenna 42. The shorted radiating portion 15 has a coupling gap 48 to the monopole 44.

In the abovementioned second and third embodiments, although some changes are made to the shape of the monopole, the first (highest) resonant mode can still be generated by simply adjusting the size of the monopole. Further, the monopole can excite the shorted radiating portion by electromagnetic coupling, and perform capacitive coupling to the first radiating branch and the second radiating branch, thereby respectively generating the second (lowest), third, and fourth resonant modes, and finally forming two wide-band operating bands.

Figure 5:
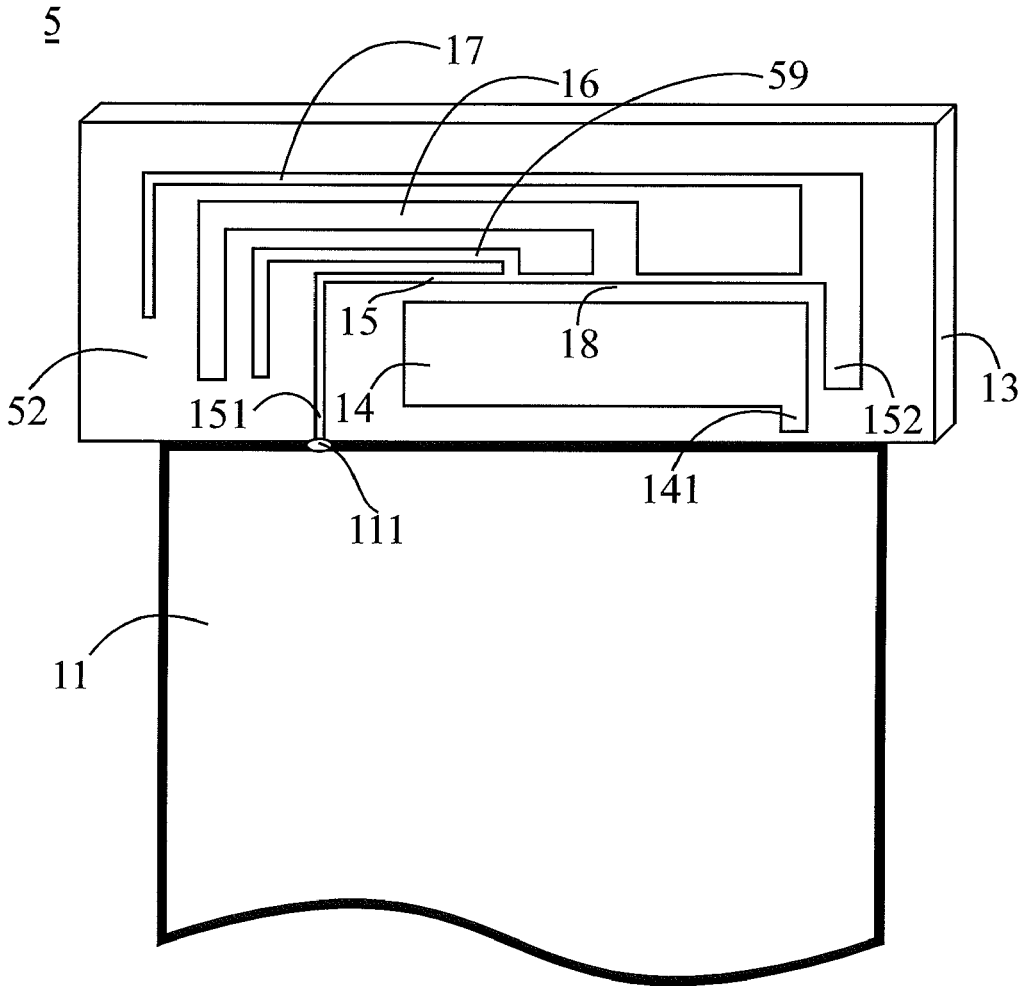
FIG. 5 illustrates a structural view of a multiband mobile communication device in a fourth embodiment of the present invention.

Then please refer to FIG. 5, which illustrates a structural view of a multiband mobile communication device in a fourth embodiment of the present invention. The multiband mobile communication device 5 has a ground plane 11 and an antenna 52. The antenna 52 comprises: a monopole 14, a shorted radiating portion 15, a first radiating branch 16, a second radiating branch 17, and a third radiating branch 59. The overall structure of the fourth embodiment is similar to that of the first embodiment, except that the fourth embodiment further comprises the third radiating branch 59, which has one end electrically connected to the shorted radiating portion 15 and the other end left open. The third radiating branch 59 is extended toward the shorting end 151 of the shorted radiating portion 15, and is located on the opposite side of the monopole 14. The third radiating branch 59 is located between the first radiating branch 16 and the shorted radiating portion 15. The third radiating branch 59 can generate an additional resonant mode to enhance the operating bandwidth of the antenna 52.

The abovementioned second embodiment, third embodiment, and fourth embodiment can all achieve results similar to those which the first embodiment does.

According to the above description, the mobile communication device of the present invention utilizes the monopole as the feeding portion of its antenna. The monopole can also generate a resonant mode (i.e. the first resonant mode) to enhance the operating bandwidth of the antenna. Meanwhile, as the monopole acts as the feeding portion of the antenna, it can excite the shorted radiating portion of the antenna by capacitive coupling, and can also excite the first radiating branch and the second radiating branch connected to the shorted radiating portion by capacitive coupling, to respectively generate resonate modes (i.e. the second, third, and fourth resonant modes). Thus, the antenna can have four resonant modes, to form two wide-band operating bands (i.e. the first and second operating bands) for respectively covering the 3-band LTE700/GSM850/900 operations and 5-band GSM1800/1900/UMTS/LTE2300/2500 operations. The antenna has a planar structure, with the shorted radiating portion extended along the monopole, the first radiating branch extended along the shorted radiating portion, and the second radiating branch extended along the first radiating branch. As a result, the size of the antenna can be efficiently miniaturized according to the above arrangement. The footprint of the antenna is about 40×15 $mm^2$ (600 $mm^2$) or even smaller, which is suitable for being applied in a compact multiband mobile communication device, especially a slim mobile communication device.

It is noted that the above-mentioned embodiments are only for illustration. It is intended that the present invention covers modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A multiband mobile communication device having a ground plane and an antenna, wherein the antenna is disposed on a dielectric substrate, the antenna comprising:

a monopole including a feeding end which is a feeding point of the antenna, with the monopole generating a first resonant mode of the antenna;

a shorted radiating portion having one end as a shorting end electrically connected to the ground plane and another end left open, with the shorted radiating portion extending along the monopole and having a coupling gap to the monopole, with the shorted radiating portion generating a second resonant mode of the antenna by coupling excitation of the monopole;

a first radiating branch having one end electrically connected to the shorted radiating portion and another end left open, with the first radiating branch extending toward the shorting end of the shorted radiating portion, with the shorted radiating portion located between the first radiating branch and the monopole, with the first radiating branch generating a third resonant mode, wherein the third resonant mode and the first resonant mode form a first operating band of the antenna; and a second radiating branch having one end electrically connected to the shorted radiating portion and another end left open, with the second radiating branch extending along the first radiating branch, with the first radiating branch located between the second radiating branch and the shorted radiating portion, with the second radiating branch generating a fourth resonant mode, wherein the fourth resonant mode and the second resonant mode form a second operating band of the antenna.

2. The multiband mobile communication device as claimed in claim 1, wherein the coupling gap is less than 2 mm.

3. The multiband mobile communication device as claimed in claim 1, wherein the monopole is approximately of an inverted-L shape, T shape, or inverted-U shape.

4. The multiband mobile communication device as claimed in claim 1, wherein the ground plane is a system ground plane of a mobile phone.

5. The multiband mobile communication device as claimed in claim 1, wherein the first operating band covers 1710~2690 MHz.

6. The multiband mobile communication device as claimed in claim 1, wherein the second operating band covers 698~960 MHz.

7. The multiband mobile communication device as claimed in claim 1, wherein the antenna comprises a third radiating branch having one end electrically connected to the shorted radiating portion and another end left open, with the third radiating branch extending toward the shorting end of the shorted radiating portion, with the third radiating branch located between the first radiating branch and the shorted radiating portion, with the third radiating branch generating a resonant mode for enhancing an operating bandwidth of the antenna.

8. An antenna used in a mobile communication device having a ground plane, the antenna comprising:

a monopole including a feeding end which is a feeding point of the antenna, with the monopole generating a first resonant mode of the antenna;

a shorted radiating portion having one end as a shorting end electrically connected to the ground plane and another end left open, with the shorted radiating portion extending along the monopole and having a coupling gap to the monopole, with the shorted radiating portion generating a second resonant mode of the antenna by coupling excitation of the monopole;

a first radiating branch having one end electrically connected to the shorted radiating portion and another end left open, with the first radiating branch extending toward the shorting end of the shorted radiating portion, with the shorted radiating portion located between the first radiating branch and the monopole, with the first radiating branch generating a third resonant mode, wherein the third resonant mode and the first resonant mode form a first operating band of the antenna; and a second radiating branch having one end electrically connected to the shorted radiating portion and another end left open, with the second radiating branch extending along the first radiating branch, with the first radiating branch located between the second radiating branch and the shorted radiating branch, with the second radiating branch generating a fourth resonant mode, wherein the fourth resonant mode and the second resonant mode form a second operating band of the antenna.

9. The antenna as claimed in claim 8, wherein the antenna is disposed on a dielectric substrate.

* * * * *